United States Patent [19]

Schmidt

[11] 4,221,157

[45] Sep. 9, 1980

[54] PNEUMATICALLY OPERATED PERCUSSION BORING APPARATUS

[76] Inventor: Paul Schmidt, Winterberger Str. 70, Lennestadt 14, Fed. Rep. of Germany, 5940

[21] Appl. No.: 813,238

[22] Filed: Jul. 6, 1977

[30] Foreign Application Priority Data

Jul. 29, 1976 [DE] Fed. Rep. of Germany ..... 2634066

[51] Int. Cl.[2] ..... F15B 13/04; F15B 15/17

[52] U.S. Cl. ..... 91/416; 91/417 R; 173/91; 173/135

[58] Field of Search ..... 91/216 B, 234, 235, 91/321, 417 R, 416; 173/91, 135

[56] References Cited

U.S. PATENT DOCUMENTS

| | | | |
|---|---|---|---|
| 2,840,045 | 6/1958 | Douglas | 91/470 X |
| 3,727,701 | 4/1973 | Sudnishnikov et al. | 173/91 |
| 3,891,036 | 6/1975 | Schmidt | 173/91 |
| 3,952,813 | 4/1976 | Chepurndi et al. | 173/91 |
| 3,995,702 | 12/1976 | Klimashko et al. | 173/91 |

*Primary Examiner*—Irwin C. Cohen
*Attorney, Agent, or Firm*—Toren, McGeady and Stanger

[57] ABSTRACT

A self-propelled pneumatically operated percussion boring apparatus for boring holes in the ground of the kind which includes a percussion piston which is reciprocated pneumatically in a tubular housing is provided with a control device for causing the apparatus to make either a forward movement or a return movement. The control device comprises a control sleeve which has air ports through its wall and over which a skirt of the piston passes as, in operation, the piston reciprocates. The skirt has ports which come into register with ports in the sleeve and the sleeve is fixed in position in the housing and has a control tube rotatably mounted within it. The control tube has one or more ports through its wall and compressd air for operating the apparatus is supplied through the control tube. The control tube is set in either one of two positions, in one of which the port or ports in the control tube are out of register with a port or ports in the sleeve and this causes the apparatus to move in one direction and in the second position the port or ports in the control tube are in register with the port or ports in the sleeve and this causes the apparatus to move in an opposite direction.

12 Claims, 5 Drawing Figures

PNEUMATICALLY OPERATED PERCUSSION BORING APPARATUS

This invention relates to self-propelled pneumatically operated percussion boring apparatus for boring holes in the ground of the kind including a percussion piston which is reciprocated pneumatically in a tubular housing. The invention is particularly concerned with a control device in apparatus of this kind for causing the apparatus to make either a forward boring movement of a return movement from the bored hole.

In a known control device in such apparatus as described in German Pat. No. 2,157,259, and the corresponding U.S. Pat. No. 3,865,200 changing over from forward to return movement is carried out by means of a cable, which acts upon an arresting lever. This lever is pivotally mounted on a control sleeve and axially adjusts a bush which is slidably mounted on the control sleeve.

Reversing of the operation of the percussion piston to bring about return movement can also be carried out without an arresting lever, if the control sleeve is formed as a tube and is axially movably mounted in a ring of the housing which is provided with venting bores. With this arrangement, however, the changing over is also usually effected by means of a cable. Alternatively a spring may be used, and the control sleeve can then be automatically moved into the operating position for effecting return movement by means of the pressure of the compressed air which is supplied to operate the apparatus. In this case, a detent holds the control sleeve in the operating position for forward movement, that is before changing over to return movement, and prevents the control sleeve from moving unintentionally into the operating position for return movement under the pressure of the compressed air.

In a percussion boring apparatus disclosed in German Pat. No. 1,634,417, the control sleeve, which extends into a bore having radial apertures at the rear end of the percussion piston, is axially adjusted in position for the purpose of changing over from forward to return movement. The adjustment is carried out by screwing the control sleeve forwards and backwards in a flange. To carry out axial adjustment of the control sleeve, a compressed air line connected to the control sleeve must be disconnected from the compressed air source and be rotated several times. In practice up to fifteen turns are required before the control sleeve is screwed fully up to a stop in the flange. The compressed air line must then be reconnected to the compressed air source and the apparatus can then move backwards. This form of control suffers from the serious disadvantage that, when the apparatus is supplied with air through very long air hoses up to 50 to 80 m in length, the hose is very difficult to rotate, especially if the ground in which the hole is bored falls in during the required numerous rotations of the hose.

Yet another control device for the forward and return movement of percussion boring apparatus of the kind described is disclosed in German Pat. No. 2,340,751 and the corresponding U.S. Pat. No. 3,891,036. In this device a control sleeve is held in either one of two operating positions by stops against a guide ring provided with venting bores. The control sleeve has a releasable rotational arresting device and stops, which become aligned with longitudinal recesses of the guide ring when the control sleeve is appropriately rotated. In this manner, the stops can be axially moved through the guide ring with the control sleeve, in order, for example, to change the apparatus over from forward to return movement. A further rotation of the control sleeve effects renewed arresting of the control sleeve by stops situated on both sides of the guide ring. In order to change over, the rotational arresting device must be released by means of a cable. This arrangement also thus suffers from the serious disadvantage that a pulling cable must always accompany the movement of the apparatus. This cable is liable not merely to jam but also to be damaged during return travel.

In addition, all known percussion boring apparatus of the kind described suffers from the disadvantage that the control edges of the control sleeve always adopt a position either in the forward setting or the return setting. In other words it is not possible for the forward and rearward control edges of the control sleeve, which regulate the air flow through radial control ports of the percussion piston, to be individually adjusted in an optimum manner for effecting the forward and backward movements. The position of these control edges also however influences the length of the stroke of the piston, the power of the individual blows of the piston, the frequency of blows and the air consumption.

The aim of the present invention is to provide a control device for controlling the forward and return movements of apparatus of the kind described which does not suffer from the aforementioned disadvantages and by which the apparatus can be changed over in a simple manner from forward to return movement and vice versa.

According to this invention, we provide a self-propelled penumatically operated percussion boring apparatus for boring holes in the ground of the kind including a percussion piston which is reciprocated pneumatically in a tubular housing, wherein a control device is provided for causing the apparatus to make either a forward movement or a return movement, the control device comprising a control sleeve which has air flow ports through its wall and over which a skirt of the piston passes as, in operation, the piston reciprocates, the skirt having ports which come into register with the ports in the sleeve, the sleeve being fixed in position in the housing and having a control tube movably mounted within it, the control tube having an inlet for compressed air and having at least one port through its wall, whereby movement of the control tube within the sleeve causes the port or ports in the control tube to move from a first position out of register with a port or ports in the sleeve in which the supply of compressed air through the tube causes the apparatus to move in one direction into a second position in register with a port or ports in the sleeve in which the supply of compressed air through the tube causes the apparatus to move in an opposite direction.

With this arrangement, it is readily possible to adjust in an optimum manner the control device both for forward and also for return movement. Thus, for example, the return impulse can be considerably intensified by displacing the rearward control edge of the control sleeve, because the air can then not escape so soon.

Preferably, the control sleeve is fixed to a tubular extension of a guide ring which is fixed in the housing and is provided with axial venting bores for venting to atmosphere the compressed air supplied to the apparatus. The tubular extension and the guide ring are preferably formed integrally with each other.

The tubular extension and the guide sleeve may be fixed to each other by webs which radiate from the extension and have axial grooves between them.

The control tube advantageously has a shaft portion and an enlarged head with a tapering transition comprising diametrically opposed flattened area between the shaft portion and the head. Preferably also, the control tube is mounted for limited rotation inside the control sleeve. In this way, it is possible by simple rotation of the control tube to make or to interrupt the connection necessary for forward or return movement between the ports in the control sleeve, the control tube and the percussion piston, and thereby to obtain a change over from forward to return movement and vice versa.

The control ports of the control tube may be situated in the head and are brought by rotation of the control tube into register with the control ports in the control sleeve. In order that the control operation shall not take place unintentionally, a detent device is preferably disposed upon the side of the guide ring remote from the tubular extension. Stop means for limiting the rotational movement of the control tube may be provided to ensure that the detent device engages correctly.

An example of a percussion boring apparatus provided with a control device in accordance with the invention will now be described with reference to the accompanying drawings, in which.

Figure 1:
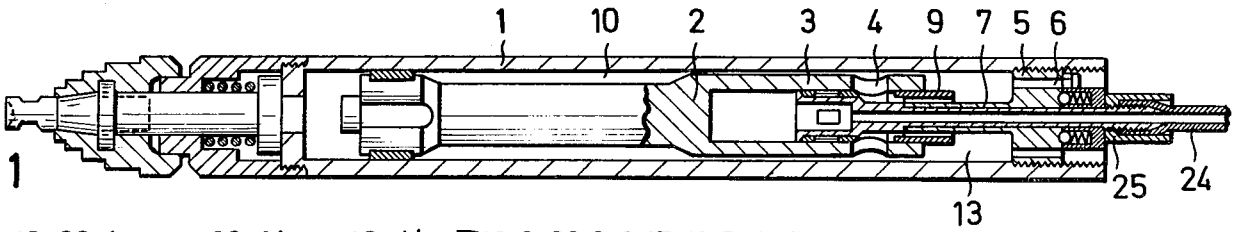
FIG. 1 is a longitudinal section through the apparatus.
Figure 2:
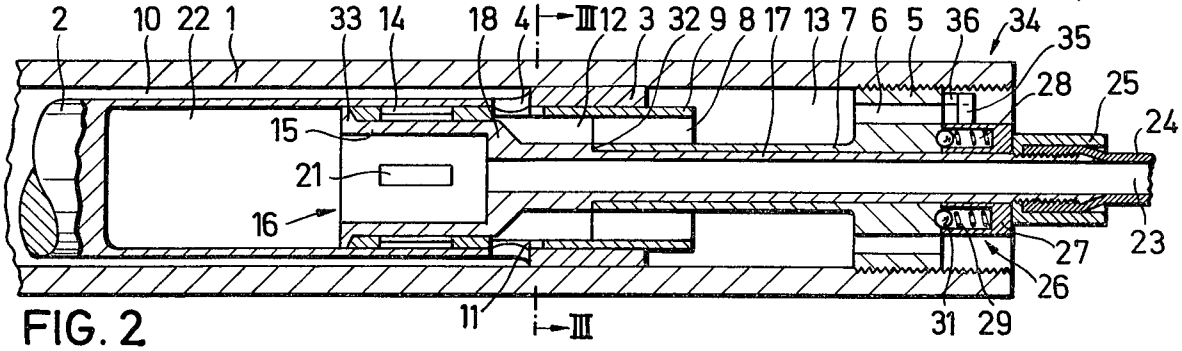
FIG. 2 is a longitudinal section to a larger scale through the control device of the apparatus.

The percussion boring apparatus comprises a tubular housing 1, in which a percussion piston 2 is reciprocable with an annular space 10 around it. At its rear or right-hand end, the percussion piston 2 has a skirt 3 comprising radial control ports 4, interconnected by an internal annular groove 41 (FIG. 4). At the rear end of the housing 1, there is a guide ring 5 comprising axial venting bores 6, which lead to the outside atmosphere. The guide ring 5 has a tubular extension 7, to which a control sleeve 9 is attached by means of radial webs 8. In the control sleeve 9, there are radial passages 11, which in the operating setting shown in FIG. 2 are in register with the control ports 4 of the piston skirt 3. Axial grooves 12, which lead from the passages 11 into a control chamber 13, extend between the webs 8. In the control sleeve 9, there are further through passages 14, which as shown in FIG. 2, are closed by a control head 15 mounted on a rotatable control tube 16. The control tube 16 consists, in addition to the enlarged control head 15, of a shaft 17 and of a transition 18, situated between the shaft and the control head 15. As can be seen from FIG. 3, two diametrically opposed flattened areas 19 are situated in the region of the transition 18. In the control head 15, there are still further control ports 21 which, as will be explained in more detail below, can be brought into register with the passages 14 in the control sleeve 9. The relevant portion of the control head 15 is made hollow to save weight, and leads into a working chamber 22 of the percussion piston 2.

The control tube 16 has a central bore 23 extending into the control head 15 and having connected to its rear end a compressed air hose 24, which leads to a compressed air source, not shown. A clamping nut 25 serves for attaching the compressed air hose 24 to the control tube 16. A detent device 26 acts to hold the control tube 16 in a particular angular position into which it is turned. This detent device consists of a bearing component 27 comprising bores 28, in which are seated balls 31 under the action of springs 29. The balls engage partly in cups in the end face of the guide ring 5. By the action of the springs 29 and the balls 31, bearing against the guide ring, the control tube 16 is pressed to the right, so that its shoulder 32 bears firmly against the end face of the tubular extension 7 of the guide ring 5. In addition, the head 15 of the control tube 16 bears by means of a flange 33 against the control sleeve 9.

There is also a rotation limiting device 34 in the region of the detent device 26. The device 34 consists of a lug 35, projecting radially from the bearing component 27, and of two stops 36, 37, extending axially from the guide ring 5 and offset one from another by an angle of about 90°.

Figure 3:
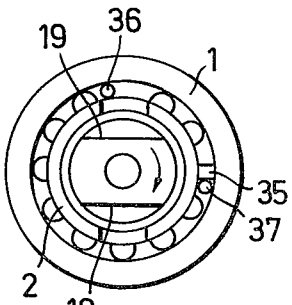
FIG. 3 is a section on the line III—III of FIG. 2.
Figure 4:
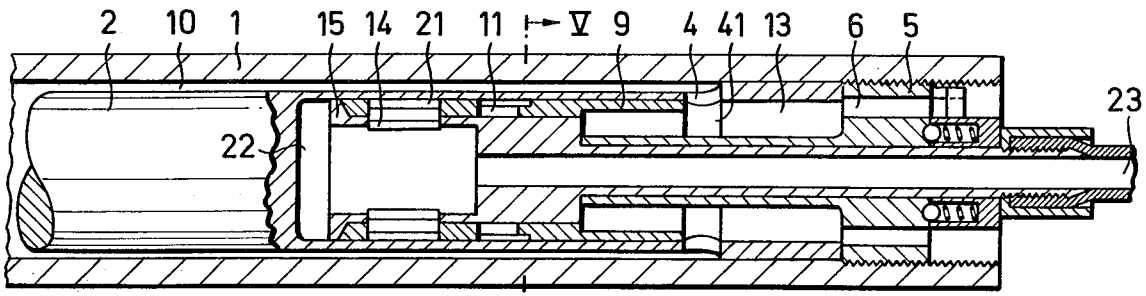
FIG. 4 is a longitudinal section corresponding to that of FIG. 2, but showing the control device in another operating setting; and, FIG. 5 is a section on the line V—V of FIG. 4.

In the setting of the individual parts of the percussion boring apparatus for forward movement, illustrated in FIGS. 2 and 3, compressed air passes from the bore 23 into the control head 15 and thence into the working chamber 22. As a result, the percussion piston 2 is moved towards the left in the housing 1. Simultaneously, compressed air is displaced on the forward end face (not shown) of the piston 2 and this air passes via the annular space 10 between the housing 1 and the external face of the percussion piston 2 as far as the control ports 4 and passages 11, and also thence via the axial grooves 12 into the control chamber 13, whence it finally escapes into the atmosphere via the venting bores 6 in the guide ring 5. During the forward travel of the piston, the compressed air acts upon the left-hand end face of the control tube 16 and presses the shoulder 32 of the tube 16 against the tubular extension 7 of the guide ring 5. The resultant friction between the shoulder and the end face of the tube prevents unintentional rotation of the tube 16. As already explained above, the springs 29 of the detent device 26 simultaneously act in the same direction on the control tube 16, so that the control tube remains, during forward travel, in the position shown in FIG. 2 as a result of the pressure of the compressed air and the force of the springs 29. This rotational position is additionally ensured by the fact that the lug 35 bears against a stop 37 of the guide ring 5.

Figure 5:
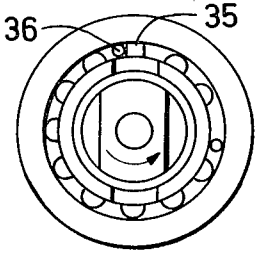

To change over the control device from the forward setting illustrated in FIGS. 2 and 3 to the return setting illustrated in FIGS. 4 and 5, the compressed air supply must first be briefly shut off, so that the force of the compressed air no longer acts upon the control tube 16 and the above-described friction between the control tube 16 and the tubular extension 7 is removed. The control tube 16 is then rotated and in doing this, only the adjustable compressive force of the springs 29 of the balls 31 needs to be overcome, that is to say only a comparatively small force is now required for rotating the control tube 16, so that this can be carried out relatively easily by twisting the hose 24 even though this may be long. After rotation of the control tube 16 through about 90°, which brings about adjustment from forward to return travel of the apparatus, the lug 35 bears against the other stop 36, so that the detent device 26 can engage in the correct position.

In the setting for return travel, the percussion piston 2 adopts the position illustrated in FIG. 4, that is to say it moves up to the guide ring 5. As a result of the associated relative displacement of the percussion piston 2 with respect to the stationary control sleeve 9, the passages 11 in the control sleeve are now closed by the percussion piston skirt, whereas the control ports 14 and control ports 21 are open. Therefore, the compressed air passes from the bore 23 into the control head 15 and thus into the working chamber 22, whence it can also simultaneously enter the passages 21 and 14, which however are initially still closed by the percussion piston skirt. The percussion piston consequently initially moves towards the left, the air situated ahead of its end face again passing via the annular space 10 between the housing 1 and percussion piston 2, to the control ports 4, which are now situated behind the control sleeve 9, and thus render possible the escape of the used air via the control chamber 13 and venting bores 6 in the guide ring 5 into the atmosphere. The annular groove 41 ensures that, even when the percussion piston is rotated, the compressed air can still pass through the openings 14, 21 to the openings 4.

For changing over from forward to return movement and vice versa, it is thus only necessary, with the apparatus in accordance with this invention, for the control tube 16 to be rotated through about 90° either fully to the right as far as the one stop or fully to the left as far as the other stop. With a right-hand rotation, the apparatus moves forwards, whereas with a left-hand rotation, it makes a return movement.

I claim:

1. In a self-propelled pneumatically operated percussion boring apparatus for boring holes in the ground, said apparatus including an axially extending tubular housing having a front end and a rear end spaced axially from the front end, a percussion piston located within and displaceable in the axial direction of said housing and including a portion in sliding sealing engagement with said housing, means for pneumatically reciprocating said piston in said housing including a control device for controlling the supply of air within said housing selectively along either one of two paths, in one of which paths said piston causes said apparatus to move in the axial direction outwardly from the front end of said housing and in the other of which paths said piston causes said apparatus to move in the opposite direction axially from the rear end of the said housing wherein the improvement comprises that said control device includes a control sleeve, means fixedly mounting said control sleeve within said tubular housing against movement in the axial and rotational direction of said tubular housing, said sleeve including a peripheral wall having air flow ports therethrough spaced apart in the axial direction of said tubular housing, an annular skirt extending from said piston toward the rear end of said housing and slidable on said control sleeve, a rotatable control tube located within said housing extending through said control sleeve into said skirt means for fixedly mounting said control tube in said control sleeve for preventing relative axial movement between said control tube and control sleeve, said control sleeve mounting means including an annular and face within said housing, and said control tube mounting means includes an annular shoulder within said housing engaging said end face for preventing said axial movement of said control tube, and the combination of said skirt and the end of said control tube closer to the front end of said housing defining a variable chamber due to the axial displacement of said piston relative to said axially fixedly mounted tube, said piston having a first surface within said chamber therein extending transversely of the axial direction of said tubular housing and acted on by the compressed air for moving said piston along the one of said paths and having a second surface extending transversely of the axial direction of said tubular housing and whose area is greater than the first surface and is located exteriorly of said chamber and when acted on by the compressed air moves said piston along the other of said paths, said skirt having ports extending therethrough, said ports in said skirt moving into and out of register with said ports through said wall of said control sleeve and with the chamber within said skirt of said piston as said piston reciprocates in said housing, said control tube including an axially extending tubular wall, said tubular wall in said control tube having at least one air flow port therethrough, means for supplying compressed air to said control tube, said means for supplying compressed air comprising a compressed air hose connected to said control tube so that rotating said compressed air hose effects a corresponding rotation of said control tube, and said control tube being rotatably mounted within said skirt of said piston about the axis of said housing between a first position and a second position, whereby when said control tube is in said first position, said at least one port through said tubular wall of said control tube is out of register with said ports through said wall of said control sleeve closer to the front end of said housing and compressed air flows from said control tube into said chamber within said skirt in said piston along the one of the paths through said apparatus and causes said piston to move said apparatus in the direction outwardly from the front end of said housing while air flows from adjacent said second surface to exhaust via an air flow port in said skirt and when said control tube is rotated relative to said control sleeve and said skirt of said piston into said second position, said at least one port through said wall of said control tube is in register with at least one of said ports through said wall of said sleeve closer to the front end of said housing and the compressed air flows from said control tube outwardly from said chamber along the other of the paths through said apparatus and acts on the second surface of said piston while concurrently acting on said first surface and causes said piston to move said apparatus in the direction opposite and axially outwardly from the rear end of said housing.

2. Apparatus as claimed in claim 1, further comprising a guide ring, means fixing said guide ring in the rear end of said housing, a tubular extension extending from said guide ring toward the front end of said housing, said means fixedly mounting said control sleeve fixes said control sleeve on said tubular extension and said guide ring having at least one axial venting bore therethrough for venting to the atmosphere compressed air supplied to said apparatus through said control tube.

3. Apparatus as claimed in claim 2, wherein said tubular extension and said guide ring are integral with each other.

4. Apparatus as claimed in claim 2, further comprising axially extending webs radiating outwardly from said extension and means fixing said control sleeve to said webs.

5. Apparatus as claimed in claim 1, further comprising means mounting said control tube for limiting the angular extent of the rotation of said control tube inside said control sleeve.

6. Apparatus as claimed in claim 5, in which said control tube includes an axially extending shaft portion, an enlarged head portion at the end of said shaft portion closer to the front end of said housing and including said tubular wall, a tapering transition between said shaft portion and said enlarged head and said transition having diametrically opposed flattened areas between said shaft portion and said head.

7. Apparatus as claimed in claim 6, wherein said at least one air flow port of said control tube is situated in said tubular wall included in said head and is brought by rotation of said control tube into register with said ports through said wall of said sleeve closer to the front end of said housing.

8. Apparatus as claimed in claim 7, wherein said tubular extension includes said annular end face remote from said guide ring and said control tube includes said annular shoulder between said transition and said shaft portion.

9. Apparatus as claimed in claim 8, further comprising detent means for holding said control tube in a set angular position, and means mounting said detent means upon that side of said guide ring which is remote from said tubular extension.

10. Apparatus as claimed in claim 9, wherein said detent means includes a bearing component fixed on said control tube and having axially extending bores therein, a ball situated in each said bore, springs situated in each said bore, said guide rings having depressions therein, said springs arranged to bias said balls into said depressions.

11. Apparatus as claimed in claim 10, further comprising stop means for limiting the rotational movement of said control tube.

12. Apparatus as claimed in claim 11, wherein said stop means includes a lug projecting radially from said bearing component and stops projecting axially from said guide ring.

* * * * *